United States Patent [19]

Senior

[11] Patent Number: 4,672,878

[45] Date of Patent: Jun. 16, 1987

[54] HEAD JOINTS FOR TRANSVERSE FLUTES

[76] Inventor: Ian S. T. Senior, 23 Vicarage Lane, King's Langley, Hertfordshire, WD4 9HS, England

[21] Appl. No.: 828,690

[22] Filed: Feb. 12, 1986

[30] Foreign Application Priority Data

Feb. 13, 1985 [GB] United Kingdom ..... 8503692

[51] Int. Cl.[4] ..... G10D 7/02

[52] U.S. Cl. ..... 84/384

[58] Field of Search ..... 84/384

[56] References Cited

U.S. PATENT DOCUMENTS 3,685,388 8/1972 Young ..... 84/384

FOREIGN PATENT DOCUMENTS 102763 1/1938 Australia ..... 84/384
222110 1/1959 Australia ..... 84/384
260291 9/1928 Italy ..... 84/384
1333530 10/1973 United Kingdom ..... 84/384

*Primary Examiner*—Lawrence R. Franklin
*Attorney, Agent, or Firm*—Laubscher & Laubscher

[57] ABSTRACT

A head joint for a transverse flute comprises a hollow cylindrical wall 2 which terminates at its rearward end 4 adjacent an embouchure hole 3 extending through the cylindrical wall. The embouchure hole communicates with an acoustic chamber 5 defined within the cylndrical wall. A cap 12, fashioned with a rigid end wall 13 in the shape of a disc with the periphery of which is integral an axially extending annular flange 14, closes the rearward end of the cylindrical wall. The cap is fitted to the cylindrical wall with its annular flange making an airtight joint with the periphery of the cylindrical wall and with its rigid disc defining one end of the acoustic chamber. The cap may be a push fit over the cylindrical wall or be a push fit internally of the cylindrical wall. Alternatively, the cap could be screwthreaded to the outside or inside of the cylindrical wall. The axial position of the cap relative to the embouchure hole can, therefore, be adjusted, and the cap readily removed so that it and the interior of the head joint can be quickly cleaned. The cap may have an integral cylindrical extension directed from the periphery of its disc axially away from the annular flange to increase the length of the body of the head joint rearwardly of the embouchure hole. The cap improves the acoustic characteristics of the flute.

8 Claims, 7 Drawing Figures

PRIOR ART

HEAD JOINTS FOR TRANSVERSE FLUTES

BRIEF DESCRIPTION OF THE PRIOR ART

This invention relates to head joints for transverse flutes.

Transverse flutes, which include the concert flute and the piccolo, are played with the head lying almost horizontally and transversely across the player's lips. The German name is Querfloete and the Italian name is flauto traverso. These names indicate the manner of playing the instrument. Transverse flutes are distinguished from recorders and similar instruments which are played with the head held between the player's lips.

SUMMARY OF THE INVENTION

In accordance with the invention, a head joint for a transverse flute has the acoustic chamber defined within its body closed airtight rearwardly of the embouchure hole through the wall of the body by a rigid member.

The invention also includes a transverse flute head joint comprising a hollow cylindrical wall with an embouchure hole therethrough and which terminates at one end adjacent the embouchure hole which communicates with an acoustic chamber defined within the cylindrical wall, and a closure device for closing said one end of the cylindrical wall, the closure device being in the form of a cap comprising a rigid end wall having an annular flange integral therewith and extending axially from its periphery, the cap being fitted to said one end of the cylindrical wall with its annular flange making an airtight joint therewith and with its rigid end wall defining one end of the acoustic chamber.

BRIEF DESCRIPTION OF THE DRAWINGS

In order that the invention may be well understood there will now be described some embodiments thereof, given by way of example, reference being had to the accompanying drawings, in which.

DETAILED DESCRIPTION

Figure 1:
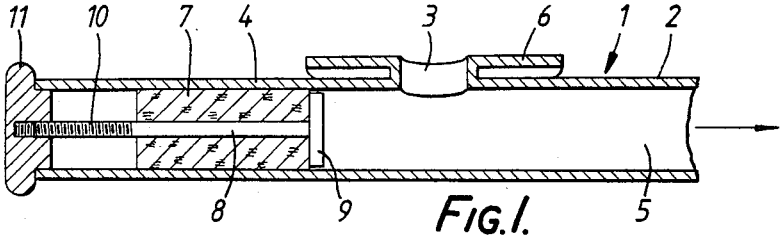
FIG. 1 is a sectional side view of a conventional head joint for a transverse flute.

Referring first to FIG. 1, a conventional head joint 1 for a transverse flute includes a cylindrical wall 2 which is adapted to interconnect at its forward end, denoted by an arrow, to the flute body. A hole 3 extends through the cylindrical wall 2 nearer to its rearward or closure end 4 which is remote from the instrument's body. The hole 3 is known as the embouchure and communicates with an acoustic chamber 5 defined within the cylindrical wall 2. The embouchure 3 is located in a lip plate 6, and the player blows across the embouchure to produce sound. To function correctly, the closure end 4 of the cylindrical wall 2 is sealed to make it air tight by using a cork stopper 7 located inside the cylindrical wall a short distance behind the embouchure 3. The cork 7 is a tight fit because at that point the cylindrical wall 2 is customarily tapered, narrowing in the opposite direction to the instruments' body. The cork 7 is mounted on a spindle 8 integral at one end with a circular disc 9 which engages the inner end surface of the cork. The opposite end of the spindle 8 is screwthreaded at 10 for threaded engagement with a button or crown 11 which engages the rearmost end of the cylindrical wall 2. Thus, by turning the crown 11 in the appropriate sense, the disc 9, which makes a clearance fit relative to the cylindrical wall 2, moves axially to urge the cork 7 tightly home in the tapered cylindrical bore by which the cork seals and defines one end of the acoustic chamber 5. Because of the tapering of the closure end 4 of the cylindrical wall 2 and other design characteristics, the only way to remove the cork 7 is by first unscrewing the crown 11, then, usually by means of a specially designed tool, pushing the cork past the embouchure 3 through to the forward end of the cylindrical wall. This is an awkward task which most flautists do not undertake because the cork 7 is such a tight fit and becomes extremely stiff to move when it has been in position for a little time.

The cork stopper with spindle and crown have been used in flute head joints for 200 years or so. They were first used at a time when head joints were usually made of wood, had irregular bores, and the instrument's pitch and tuning were imperfect which the adjustable cork was intended to correct. Modern flutes are made of other material, generally metal, and their tuning has been corrected by changing the tone-holes.

A flute makes notes because a column of air, supported inside the instrument, is excited by a smaller column of air passing across the embouchure. The analogy with a violin string excited by the bow is close and informative. The violin string is held at the bridge. When a mute is placed on the bridge the sound is dampened. The cork in a flute, by its very nature, can only have a dampening effect. As any flautist knows, when the instrument is responding well, vibrations can be felt throughout. Equally, the head joint is where the vibrations originate and where the sound is generated. This is demonstrated by watching any flautist playing beside a microphone. He plays with his embouchure right up to the microphone to get the best results. So what does the cork do? Simply dampen the vibrations at the point where the flute is most sensitive, holding a potentially vibrant piece of metal, the cylindrical wall of the head joint, and inhibiting it from resonating.

In the various embodiments of the invention, the customary stopper of cork together with the customary spindle and crown are replaced by a closure device in the form of a cap which renders the rearward or closure end of the cylindrical wall of the head joint fully airtight and which fits over or inside the cylindrical wall as a push or screw-threaded fit.

Figure 2:
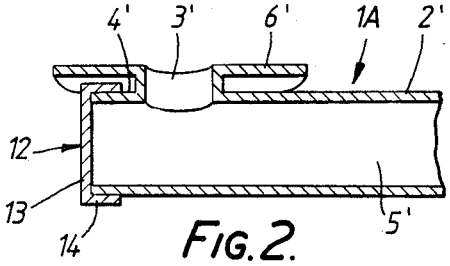
FIG. 2 is a sectional side view of a transverse flute head joint embodying the invention.
Figure 3:
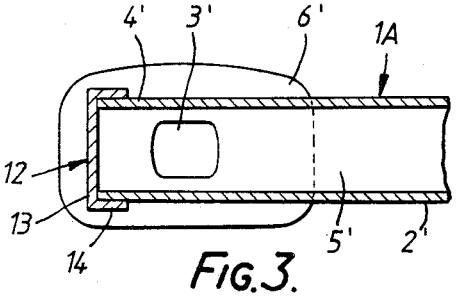
FIG. 3 is a sectional underplan view of the head joint of FIG. 2.
Figure 4:
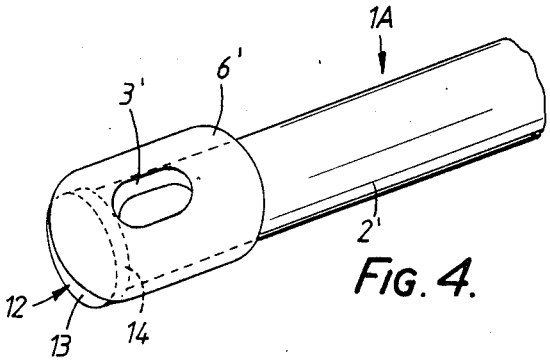
FIG. 4 is a perspective view of the head joint of FIG. 2.

Referring now to FIGS. 2 to 4 in which parts of the head joint similar to those of the conventional head joint depicted in FIG. 1 are denoted by like reference numerals, the first embodiment of head joint 1A has its cylindrical wall 2' in the region thereof extending rearwardly of the embouchure 3' shortened so that it terminates at its closure end 4' adjacent the embouchure. The cap 12 forming the closure device comprises a rigid disc or end wall 13 having an annular flange 14 integral with its periphery and extending axially. The cap 12 is fitted externally over the closure end 4' of the cylindrical wall 2' with its annular flange 14 being a push, air-tight, sliding fit upon the cylindrical wall and with its rigid disc 13 closing the cylindrical bore defined by the inner peripheral surface of the cylindrical wall to define the rearward end of the acoustic chamber 5'.

Since the cap 12 is a push, air-tight sliding fit over the closure end 4' of the cylindrical wall 2', its axial position, like the conventional cork stopper, can be set to the player's preferred position. In practice, most players set the cap 12 so that its rigid disc 13 is about 17.3 mm from the centre of the embouchure, and it follows that the cylindrical wall 2' terminates adjacent the embouchure by the same distance assuming that that represents the forward limit of the axial positions available to the cap, i.e. with its rigid disc abutting the end of the cylindrical wall.

A number of flute performance comparative tests have been carried out on a capped head joint 1A made of sterling silver and fitted on a Rudall Carte body against a conventional cork stopper head joint 1 of similar dimensions (apart from length at the closure end), also of sterling silver and fitted on a Rudall Carte body.

Figure 7:
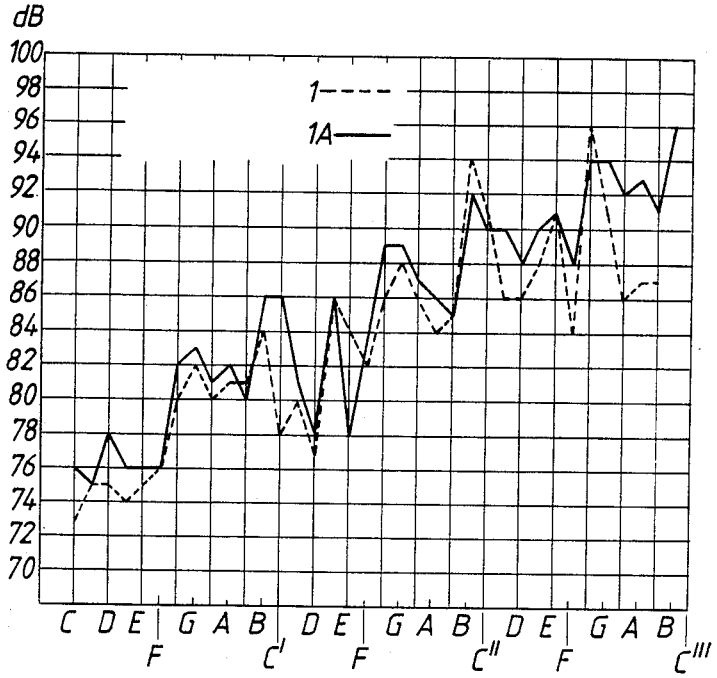
FIG. 7 is a graph comparing flute performance test data.

The first test involved measuring the volume of each note of the flute's three octaves using a decibel meter at one meter's distance from the embouchure. As shown in the graphical representation of the comparative test results depicted in FIG. 7, the volume increases steadily as the notes get higher. It is essential to use the decibel meter simultaneously with an instrument to measure pitch such as a Korg tuner, since more volume can be obtained by blowing any given note sharp. The graph shows that in the low octave the capped head joint 1A produced on average 1.71 dB more volume than the conventional cork stopper head joint 1; 0.92 dB in the middle octave; and 2.5 dB in the top octave.

The second test involved blowing each flute by fluttering the tongue down to the bottom C. The more responsive the instrument, the easier the note plays and the more the volume. The capped head point 1A gave a volume at a distance of one meter of 69 dB against the corked head joint 1 of 66 dB.

When a human blows any instrument there is the possibility of biassed results. A blowing machine has been constructed which delivers a stream of air at a pressure of 0.2 kg per $cm^2$ through an aperture with a diameter of 4 mm at an angle of 45° to the embouchure. Making the two heads play A one and a half octaves above middle C saw the capped head joint 1A give a volume of 95 dB against the cork head joint 1 of 92 dB.

The tests demonstrated that the capped head joint 1A represented a clear improvement over the traditional cork head joint design. Thus, cork which is renowned for insulating both sound and vibration is eliminated and replaced by a rigid cap which not only eliminates the damping effect of the cork but also adds a new area to the flute head through which the column of air supported in the flute can transmit vibrations to the air outside and hence to the listener.

Figure 5:
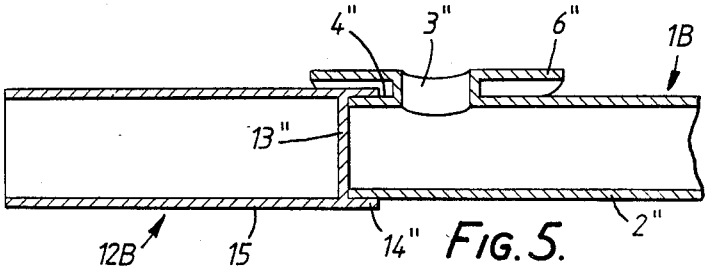
FIG. 5 is a sectional side view of an alternative head joint for a transverse flute, embodying the invention.
Figure 6:
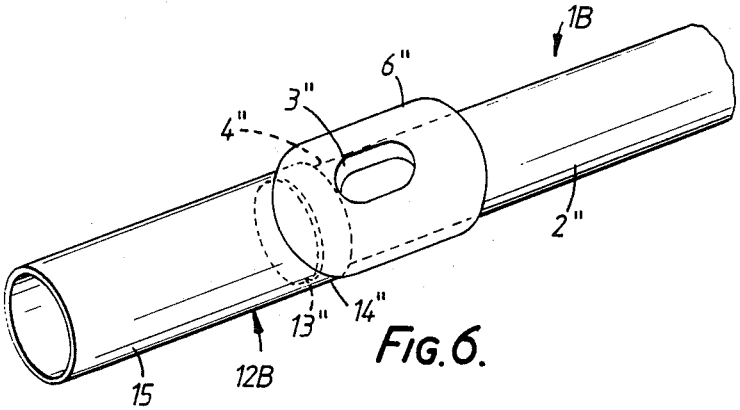
FIG. 6 is a perspective view of the head joint of FIG. 5.

Referring now to the second embodiment of head joint 1B which is depicted in FIGS. 5 and 6 and in respect of which parts which are similar to the head joint 1A are denoted by like reference numerals, the difference between the two is that the cap, referenced 12B, has a hollow cylindrical extension 15 extending rearwardly away from the rigid disc 13". The cylindrical extension 15 is integral with the periphery of the disc 13" and is of the same internal and external diameters as the annular flange 14". The overall length of the cap 12B is such that the length of the head joint 1B rearwardly of the embouchure 3" may equate with that of the conventional cork stopper head joint 1", resulting in the product having a more traditional appearance and a similar balance to that commonly in use. As before, the cap 12B makes a push, adjustable sliding, air-tight fit externally over the closure end 4" of the cylindrical wall.

The extended capped head joint 1B has been tested by being fitted to a flute blown for a continuous period of not less than 10 seconds on one note with a constant stream of air. During this time the open end of the cap 12B was fully covered and uncovered a number of times by hand or by some suitable flat object, care being taken not to disturb the position of the head joint in relation to the player in any way. On a number of notes in the flute's register, notably D, D♯, E, F and F♯ in the third octave above middle C, the improvement in volume and tone was clearly audible as the cover was removed from the end of the cap. Correspondingly a damping effect was clearly heard when the cover was put back. The improvement was also audible on F, E and D♯ in the second octave above middle C and was still discernible on F, E, D♯ and D in the octave above middle C. The improved notes included three which are most difficult to produce well on the flute, namely E and F♯ in the third octave above middle C, and E in the second octave above middle C.

When the test was carried out using the traditional head joint 1 with cork 7 and crown 11, no change was heard in the notes indicated above even when the crown was removed.

The test therefore demonstrated conclusively that the provision of the capped head joint 1B produces a significant improvement in the playing characteristics of the flute. In addition to the area added by the rigid cap of the head joint 1A which adds the discussed new area to the flute head through which the column of air supported in the flute can transmit vibrations to the ambient air and hence the listener's ear, the cylindrical extension 15 adds a further significant area which will resonate. As such, it is believed that the head joint 1B when put under the same tests as the head joint 1A will produce even better results.

Provision of the described capped head joints results in the following improvements:

(a) the cap eliminates the cork stopper mechanism which has a damping or insulating effect on the resonance of the head joint. Thus, the cap improves the resonance or other sounding characteristics of the instrument as a whole. These improved acoustic characteristics can be demonstrated in laboratory conditions, as described (b) the cap can easily be removed and replaced with the effect that the internal bore of the head joint can be cleaned more easily and thoroughly than is possible with the customary cork stopper mechanism in place. The importance of this improvement is as follows. The inside of a conventional head joint can only be reached by removing the entire head joint from the body of the instrument. Even then, the end of the cork and the area immediately adjacent to it are difficult to clean thoroughly. During performance, they become moist with condensation. Wiping away this condensation improves the instrument's playing characteristics. To the contrary, the cap can be removed by the fingers in seconds and the interior of the cap and head joint cleaned also in seconds thoroughly and without removing the head joint from the instrument's body; and (c) in a head joint 1A, the cap reduces by a significant amount the material required to make the head joint making the instrument as a whole lighter and of better balance.

Head joints constructed in accordance with the invention may incorporate caps of metal or any other suitable material such as synthetic plastics or combination of materials which provide an airtight fit.

The cap may, alternatively, be dimensioned so that it fits internally to the closure end of the head joint with the annular flange 14 making a push, air-tight sliding fit with the interior surface of the hollow cylindrical wall 2'. In such a case, a rearward axial protrusion or extension may be added to the cap to enhance the resonance of the head joint, to facilitate the cap's removal or for decoration, such as the cylindrical extension 15 which could then be of a larger external diameter than the smaller annular flange assuring smooth continuity of the external surface of the head joint.

When the cap 12 or 12B fits over or inside the cylindrical wall 2' as a screwthreaded fit, the annular flange 14 is screwthreaded on its internal or external periphery, respectively, to mate respectively with the screwthreaded external or internal periphery of the closure end 4 of the cylindrical wall.

The various alternative caps may have the disc 13 formed flat and radial with respect to the longitudinal axis of the cylindrical wall 2' as illustrated or, alternatively, the disc or end wall of the cap may be concave or convex.

I claim:

1. A transverse flute head joint, comprising (a) a hollow cylindrical wall member; and (b) a closure device for closing one end of said cylindrical wall member to define an acoustic chamber therein, said cylindrical wall member containing an embouchure hole in communication with said acoustic chamber, said closure device comprising a cap including (1) a rigid transverse end wall portion defining one end of said acoustic chamber; and (2) an integral annular flange portion extending axially from said end wall portion concentrically about said one end of said cylindrical wall member in airtight engagement with the outer peripheral surface thereof.

2. A head joint as claimed in claim 1, wherein said annular flange of said cap is push fit on said one end of said cylindrical wall member.

3. A head joint as claimed in claim 1, wherein said cap includes a hollow cylindrical extension integral with said cap end wall at the periphery thereof and extending therefrom in the opposite axial direction to said annular flange portion.

4. A head joint as claimed in claim 1, wherein the thickness of the material of said cap is substantially the same as that of said cylindrical wall member.

5. A head joint as claimed in claim 4, wherein the cap can be withdrawn from said one end of said cylindrical wall member without passing internally through the cylindrical bore therein past the embouchure hole.

6. A head joint as claimed in claim 1, wherein said rigid end wall of said cap is flat.

7. Apparatus as defined in claim 1, wherein said rigid end wall of said cap is concave relative to said acoustic chamber.

8. Apparatus as defined in claim 7, wherein said rigid end wall of said cap is convex relative to said acoustic chamber.

* * * * *